United States Patent [19]

Hardy

[11] Patent Number: 4,862,332

[45] Date of Patent: Aug. 29, 1989

[54] LIGHT FITTING SUPPORT MEMBER

[76] Inventor: Samuel F. Hardy, 554 Waverley Road, Chadstone, Victoria, Australia

[21] Appl. No.: 195,695

[22] Filed: May 18, 1988

[30] Foreign Application Priority Data

May 18, 1987 [AU] Australia ..... PI1982

[51] Int. Cl.[4] ..... F21S 1/02

[52] U.S. Cl. ..... 362/145; 362/457

[58] Field of Search ..... 362/145, 147, 148, 150, 362/404, 457

[56] References Cited

U.S. PATENT DOCUMENTS

| | | | |
|---|---|---|---|
| 1,595,976 | 8/1926 | De Reamer | 362/404 |
| 1,623,813 | 4/1927 | Schell | 362/404 |
| 1,709,614 | 4/1929 | Fadell | 362/404 |
| 2,218,731 | 10/1940 | Tuck et al. | 362/147 |
| 3,511,463 | 5/1970 | Nute, Jr. et al. | 362/404 |

*Primary Examiner*—Ira S. Lazarus
*Assistant Examiner*—Sue Hagarman
*Attorney, Agent, or Firm*—Gifford, Groh, Sheridan, Sprinkle and Dolgorukov

[57] ABSTRACT

A light fitting support member comprising a plate member securable to a ceiling or wall surface by plaster or like filling and settable material and providing an aperture for the reception of a light fitting.

4 Claims, 1 Drawing Sheet

LIGHT FITTING SUPPORT MEMBER

This invention relates to a light fitting support member and to a method of securing same to a ceiling or wall.

Prior known support members for light fittings have comprised wooden or plastic blocks, usually of circular configuration, fixed through a ceiling or wall by screws or the like. To these blocks are attached the light fixture members having the electric wire terminals and means for supporting the light fittings and shades.

These prior known fittings suffer from a number of disadvantages, one being that the location of a light fitting on a ceiling or a wall is dictated by the position of a rafter beam or a wall stud so that an effective securement can be made of the fitting to the ceiling or wall. This is particularly important when the ceiling or wall is of plaster board or similarly non-retentive material for fixing purposes.

A further disadvantage is that when the light fixture supporting block is secured in position, care must be taken by painters when painting the ceiling or wall so that the light fittings are not painted or touched with paint.

Yet a further disadvantage of these known fittings is that the conventional light fitting support blocks may not adequately cover an oversize aperture made in the ceiling or wall by the builders, resulting in the necessity to plaster fill the exposed parts of the aperture.

It is an object of the present invention to provide a light fitting support member which overcomes the disadvantages of the above-stated prior art and provides a support member which can be easily and securely fitted to a ceiling or wall, which does not rely on the location of rafter beams or wall studs for securement purposes, which allows painting close up to a light fitting without marking the light fitting with paint, and which covers up any overlay enlarged aperture for the electric cables.

According to the invention there is provided a support member for alight fitting comprising a plate member having a planar outer base rim portion provided with a plurality of apertures, an inwardly angularly extending land portion offset from the plane of said base rim portion and including a plurality of apertures and an inner planar portion extending from the inner edge of said offset portion and including a centrally located aperture.

According to a further feature of the invention there is provided a method of securing said support member to a ceiling or wall surface including the steps of applying a coating of filling and settable material to said light fitting support surface around an aperture therein, securing said base rim portion in said material so that said material extrudes through said apertures of the base rim portion and said offset land portion, and tapering outwardly the extruded material towards said support surface to provide a smooth finished surface. If desired a liquified coating of the filling and settable material may be further applied to provide a smooth tapered uninterrupted surface from the offset land portion to the ceiling or wall surface.

In order that the invention and its manner of performance may be more fully understood, reference will now be made to an embodiment of the invention as illustrated in the accompanying drawings, in which.

Figure 1:
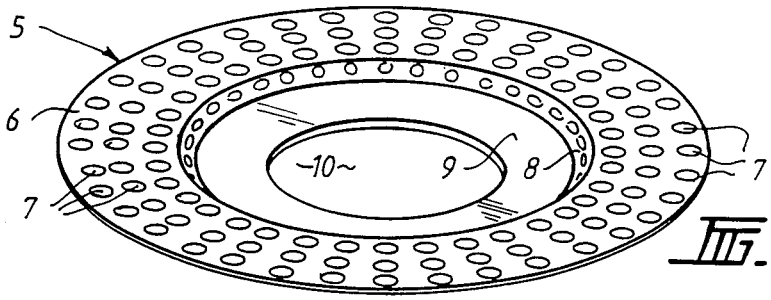
FIG. 1 is a perspective view of the light fitting support member of the invention.
Figure 2:
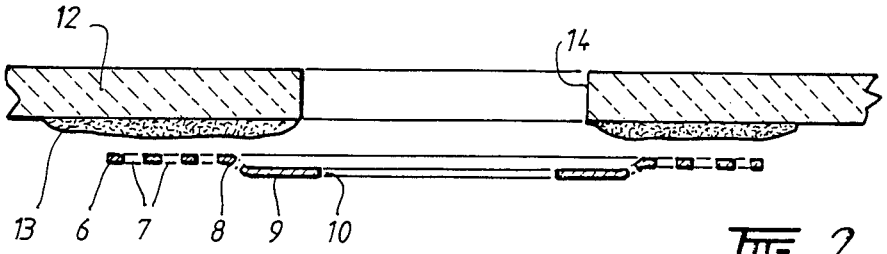
FIG. 2 is a cross-section elevational view of the initial step in the method of the invention.

Referring to the drawings, the support member 5 of the invention of relatively thin plate material comprises a base rim portion 6 provided with a plurality of apertures 7, an offset land portion 8 and also provided with apertures 7 and an inwardly extending planar portion 9 having a central aperture 10 for receiving a light fitting 11 in a removable fashion.

In application to a ceiling or wall 12, usually of plaster board, but may be of other materials, a coating of filling and settable material 13, normally plaster, is applied to the ceiling or wall 12 around an aperture 14 cut therein to allow access to an electric light cable normally run by an electrician during construction of a building.

Figure 3:
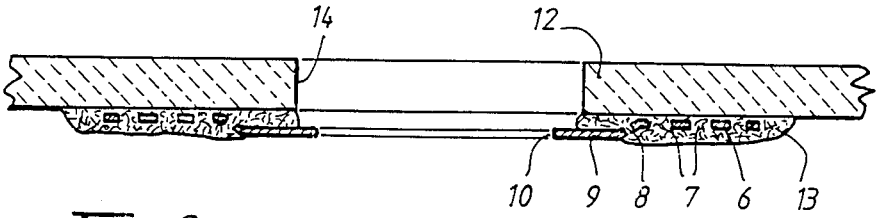
FIG. 3 is a cross-section elevational view of a further step in the method of the invention.
Figure 4:
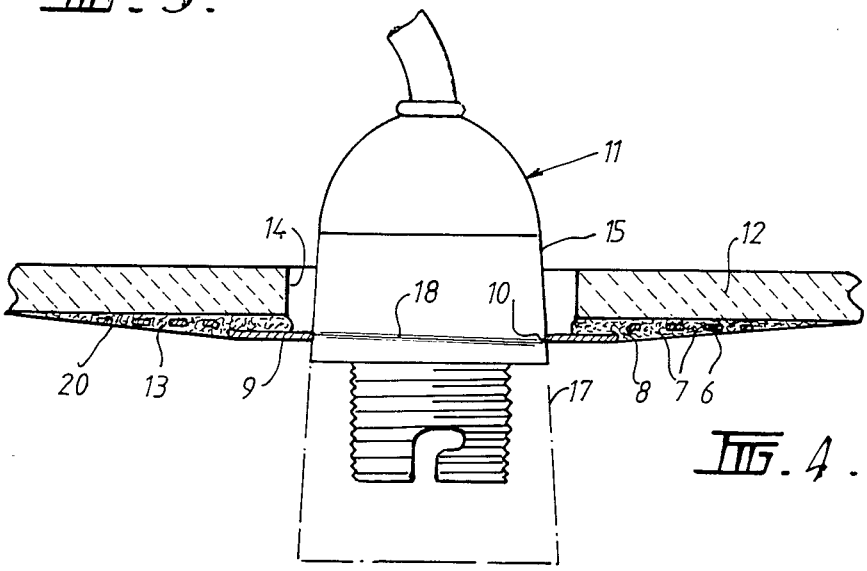
FIG. 4 is a cross-sectional elevational view of the finished attachment of the fitting support member illustrating the attachment of the light fitting.

The support member 5 is then pushed onto the coating 13 so as to be embedded therein as shown in FIG. 3 with the coating 13 being extruded through the apertures 7 of the base rim portion 6 and the offset land portion 8. The coating 13 is then smoothed outwardly to provide a tapered finish 20 blending with the ceiling or wall 12. If desired a liquified coating of the material 13 may be applied to provide a smooth finished appearance or the initial coating 13 may be sandpapered to provide the desired finish 20.

A bayonet type lamp fitting 11 may then be inserted into the central aperture 10 with the tapered portion 15 thereof above the removable shroud part 17 engaging in the aperture and cutting its own thread in the plastic material of fitting 11. Alternatively, a single thread 18 may be cut in the fitting 11 so as to assist in the securement of fitting 11.

It will be appreciated that with the support member of the present invention, the member can be removed to allow repainting of a ceiling or wall without paint being inadvertently applied to the light fitting. Also smaller and compact light fittings may be attached to support a light shade.

What is claimed:

1. A support member for securing a light fitting to a wall surrounding an aperture in said wall comprising a plate member having a planar outer base rim portion provided with a plurality of apertures, an inwardly angularly extending land portion offset from the plane of said base rim portion and including a plurality of apertures and an inner planar portion extending from the inner edge of said offset portion and including a centrally located aperture for receiving said light fitting therein, and a coating of filling and settable material applied to said wall surrounding said wall aperture to an extent to embed the planar outer base rim portion and the inwardly angularly extending land portion of said support member with said filling and settable material extending through said plurality of apertures in said rim and land portions to provide the attachment for said support member to said wall.

2. A support member according to claim 1 wherein said support member is made from a flexible sheet metal material.

3. A method of securing a support member according to claim 1 to a ceiling or wall surface including the steps of applying a coating of filling and settable material to said light fitting support surface around an aperture therein, securing said base rim portion in said material so that said material extrudes through said apertures of the base rim portion and said offset land portion, and tapering outwardly the extruded material towards said support surface to provide a smooth finished surface.

4. A method according to claim 3 wherein a liquified coating of the filling and settable material is further applied to provide a smooth tapered uninterrupted surface from the offset land portion to the ceiling or wall surface.

* * * * *